US005647975A

United States Patent [19]

Bronnec

[11] Patent Number: 5,647,975

[45] Date of Patent: Jul. 15, 1997

[54] DEVICE FOR RECOVERING POLLUTANTS SPILLED ON WATER OR ON THE GROUND

[76] Inventor: Jean Armand Louis Bronnec, 9, rue Quartier Maitre-Bondon, Brest F-29200, France

[21] Appl. No.: 578,659

[22] PCT Filed: May 5, 1995

[86] PCT No.: PCT/FR95/00585

§ 371 Date: Jan. 5, 1996

§ 102(e) Date: Jan. 5, 1996

[87] PCT Pub. No.: WO95/30798

PCT Pub. Date: Nov. 16, 1995

[30] Foreign Application Priority Data

May 6, 1994 [FR] France ..... 94 05590

[51] Int. Cl.[6] ..... E02B 15/04

[52] U.S. Cl. ..... 210/122; 210/170; 210/242.3; 210/923

[58] Field of Search ..... 210/121, 122, 210/170, 242.3, 923

[56] References Cited

U.S. PATENT DOCUMENTS

| | | | |
|---|---|---|---|
| 3,613,891 | 10/1971 | Cloutier | 210/923 |
| 3,615,017 | 10/1971 | Valdespino | 210/923 |
| 3,875,062 | 4/1975 | Rafael | 210/923 |
| 3,909,417 | 9/1975 | Rafael | 210/242.3 |
| 3,923,661 | 12/1975 | Crisafulli | 210/242.3 |
| 4,261,827 | 4/1981 | Bronnec | 210/242.3 |
| 4,264,444 | 4/1981 | Bronnec | 210/242.3 |
| 4,758,355 | 7/1988 | Levine | 210/923 |
| 4,842,735 | 6/1989 | Hollis et al. | 210/242.3 |
| 5,043,065 | 8/1991 | Propp | 210/242.3 |
| 5,087,380 | 2/1992 | De Joffoli | 210/242.3 |
| 5,215,654 | 6/1993 | Karterman | 210/122 |

FOREIGN PATENT DOCUMENTS

| | | | |
|---|---|---|---|
| 0005411 | 11/1979 | European Pat. Off. | B63B 35/32 |
| 0006823 | 1/1980 | European Pat. Off. | B63B 35/32 |
| 2200859 | 4/1974 | France | E02B 15/04 |
| 2428709 | 1/1980 | France | E02B 15/00 |
| WO85/05644 | 12/1985 | WIPO | E02B 15/04 |

*Primary Examiner*—Christopher Upton
*Attorney, Agent, or Firm*—Greenblum & Bernstein, P.L.C.

[57] ABSTRACT

An apparatus for recovering floating materials, including a compartment with a weir for receiving the material to be recovered and a system for emptying the compartment. The weir forms at least one clean float at least partially immersed in the recovery compartment. The apparatus is remarkable in that the weir is connected to at least one float borne by a body of water outside the compartment so that it is sensitive both to changes of the level in the compartment and to the relative movement of the body of water outside. The connection between the weir and the outside float is advantageously provided by an assembly enabling relative motion between the weir and the outside float.

20 Claims, 7 Drawing Sheets

FIG. 2a
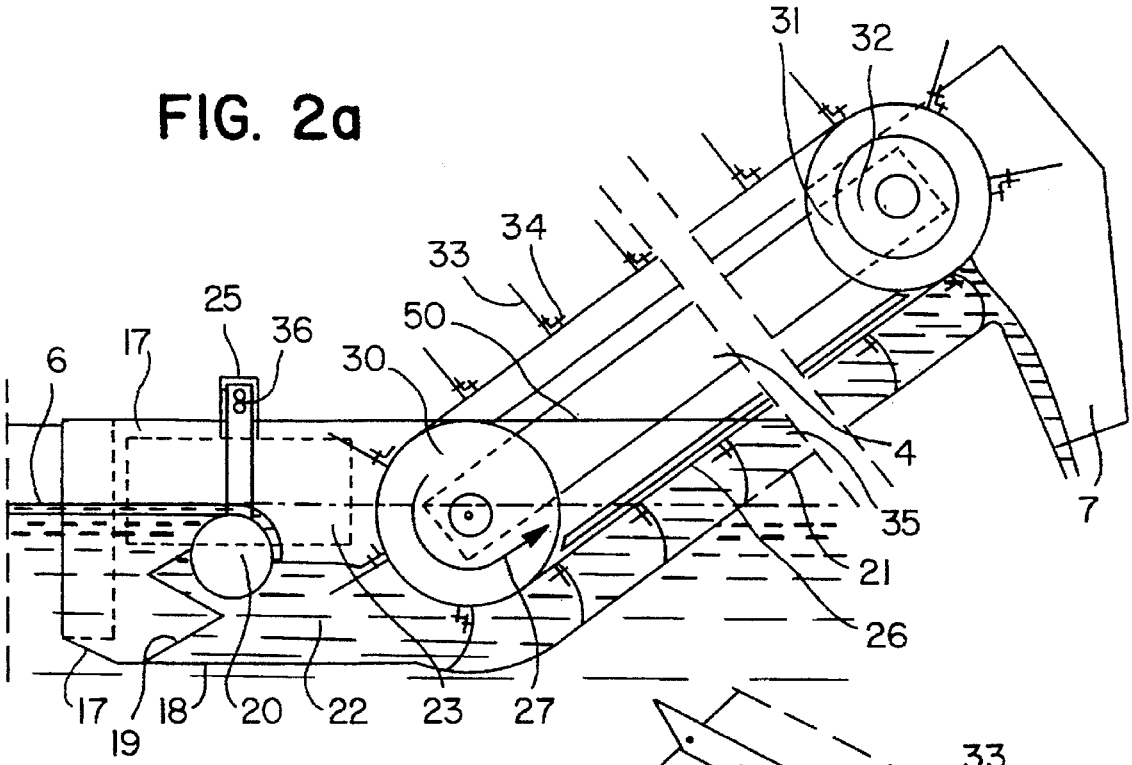
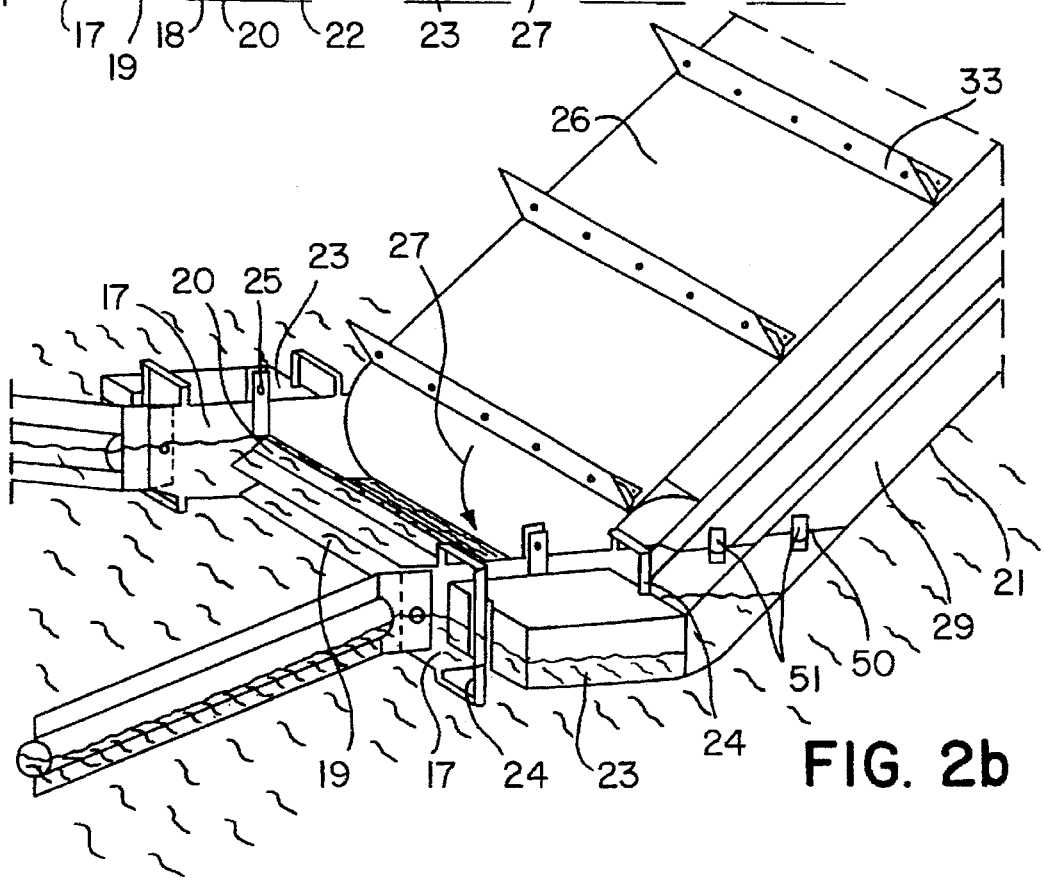
FIG. 2b

FIG. 7a
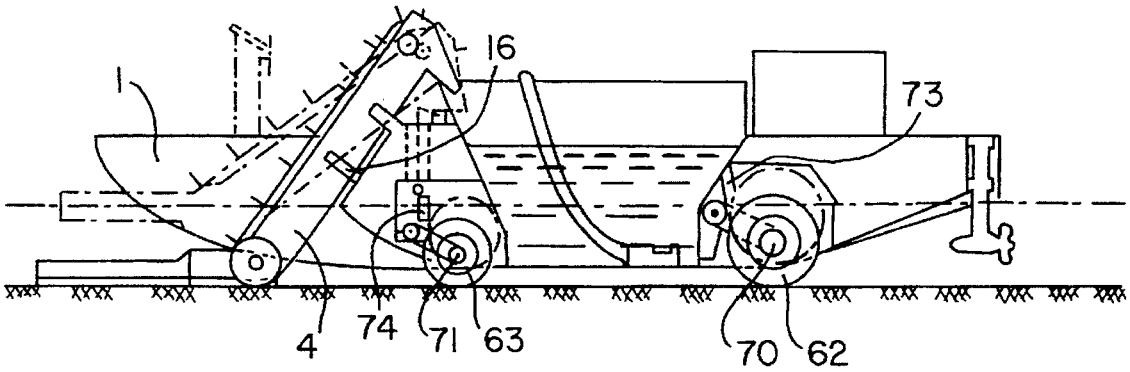
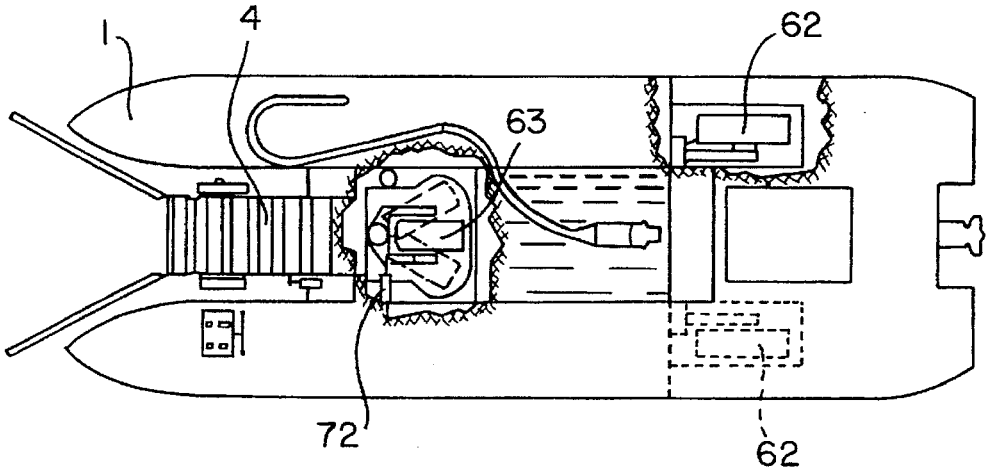
FIG. 7b

DEVICE FOR RECOVERING POLLUTANTS SPILLED ON WATER OR ON THE GROUND

BACKGROUND OF THE INVENTION

1. Field of the Invention

The present invention relates to a device for recovering pollutants spilled on the water or on the ground, as for example hydrocarbons in the sea or on the beaches.

2. Discussion of Background

To recover pollutants only on water, the document EP-A-0 005 411 describes a device whose characteristic is to separate decantation vats carried by a boat from an apparatus called a "skimming apparatus."

Such a skimming apparatus comprises a compartment with a weir adapted to receive the matter to be recovered and an emptying system of said compartment, while the weir forms or comprises at least one clean float at least partially immersed in the recovery compartment, said weir already being known and referred to as "floating weir."

When the skimming apparatus has substantial dimensions, or if the latter is affixed to a support of the storage tank, of the boat or barge type, for example, which is absolutely necessary if the emptying device is of the paddle belt type, such an apparatus is not very sensitive to the agitations or waves (such as swell or lap) of the water plane, which is a major disadvantage since there is then no consequent adaptation of the floating-weir.

FR-A-2,200,859 furthermore describes a device adapted to absorb the movement of the waves.

SUMMARY OF THE INVENTION

The inventer has designed an apparatus in which one of the objects is to maintain the weir of the recovery compartment at a substantially constant immersion level, regardless of the movements of the water plane.

To achieve this, the apparatus according to the invention, of the aforementioned floating-weir type, is notable in that the said weir is connected to at least one float borne by the exterior water plane to said compartment, in a manner to be sensitive both to the variations of level in the compartment and the relative movements of the exterior water plane.

Such an arrangement is not, indeed, known from the above mentioned devices.

The connection between the weir and the outside float is advantageously ensured by the means that enables a relative movement between said weir and outside float.

Preferably, the recovery compartment is demarcated by a weir that has the shape of a transverse float, a base, and lateral sides, said base and the weir being connected between them by a deformable partition.

Furthermore, an emptying system is known which comprises an inclined continuous belt, mounted endless between at least two drums, in which at least one is a motor, and bearing a plurality of transverse flexible paddles that are displaced in an adjusted manner in a tunnel formed of two vertical flat sides and an inclined base which is extended at its lower portion by the sides and a base demarcating the recovery compartment with the weir. The known systems of this type, from the fact that the paddles must enter the water perpendicular to the surface and that they generally comprise a projection in this area, require the said paddles to be mounted tangentially to the belt, which translates into a work and repeated bending of the paddles that wear out rapidly.

Yet, the invention makes it possible to design an apparatus equipped with such an emptying system but that is notable in that the recovery compartment reserves a space between the weir and the paddles such that the exterior edge of the said paddles can not touch the said weir, the paddles creating, at rest, an angle of about 90 degrees with the plane of the belt.

Furthermore, the floating pollutants, oil pollutants in particular, are, for the majority of time, concentrated on the beaches where they are driven ashore in substantial quantities and the existing apparatuses can not function when the depth is less than the draft and all the more so when the pollutants have run ashore on the ground, which then requires the use of special and often costly land equipment.

On the contrary, a device according to the invention, equipped with an emptying system of the aforementioned type, can permit this double function and to this end, an embodiment is notable in that the lower portion is detachable along a line of separation and is replaceable by an interchangeable assembly that is open at its lower portion to allow the flexible paddles to extend therebeyond, and that is provided with wheels enabling it to move on the ground while paddles or flexible scraping paddles are provided in such a manner as to use the apparatus for the recovery of materials scattered or driven ashore on the ground.

For an apparatus borne by a floating support comprising a storage tank, it is furthermore necessary to maintain as constant as possible, the mean immersion of the entry weir and, therefore, the support draft.

Means have already been envisioned for continuously evacuating the storage tank, based, for example, on the principle of communicating vessels, but it is clear that other factors intervene on the draft, such as, for example the unloading, and the displacement of crew and/or material, etc.

An original embodiment according to the invention is notable in that the floating support is equipped with an automatic device for maintaining the draft substantially constant, comprising a means that is sensitive to the exterior level of the water, mounted in such a manner as to act on a control device for a pump arranged to evacuate the contents of said storage tank toward the exterior in a quantity necessary to maintain the exterior level of the water in a relatively constant position with respect to the floating support.

According to a non-mandatory embodiment, the means that is sensitive to the exterior water level comprises at least one float that floats on the exterior water plane.

In a general manner, for a complete apparatus, the latter can be mounted on a support of the amphibious type that is both floating and rolling.

BRIEF DESCRIPTION OF THE DRAWINGS

The invention will be well understood from reading the following description of the embodiments given by way of non-limiting examples, and that refer to the annexed drawings, in which:

FIG. 2*a* shows in vertical cross-section and FIG. 2*b* in perspective, the details of the lower portion of the paddle belt type lifting system around its opening with its double floatability entry weir, in the "floating" configuration, FIG. 7*a* is a vertical cross-section and FIG. 7*b* is a planar view of the assembly of the equipment in the amphibious configuration.

DESCRIPTION OF THE PREFERRED EMBODIMENT

Figure 1A:
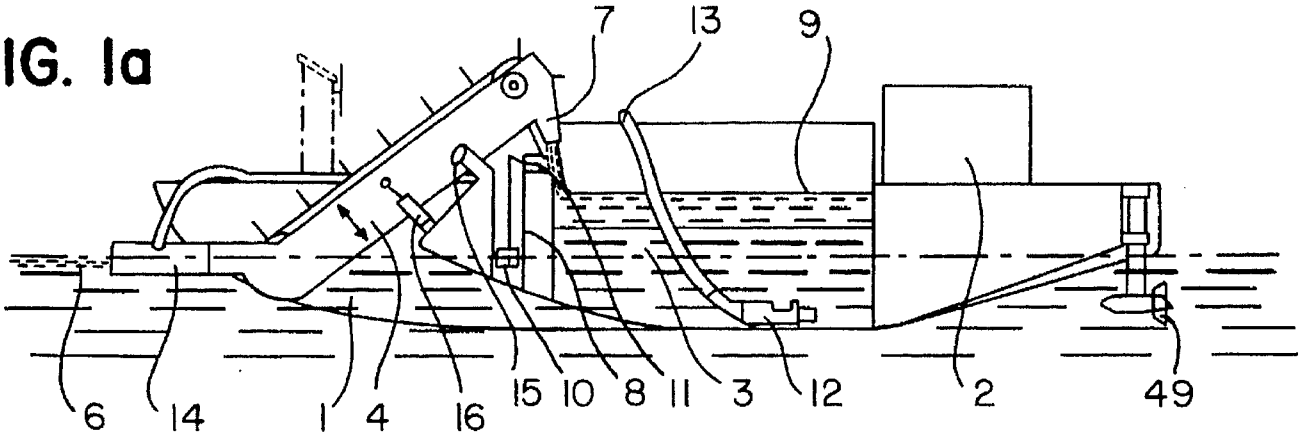
FIG. 1*a* is a vertical cross-section and FIG. 1*b* is a planar view, of the assembly of a recovery equipment according to the invention in its "floating" configuration.
Figure 1B:
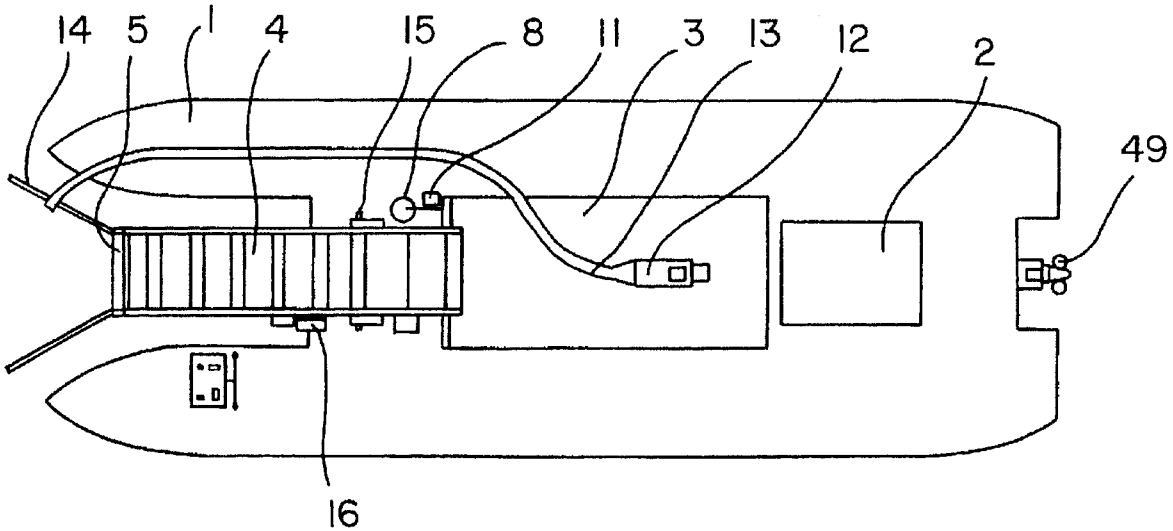

The assembly of the pollutant recovery equipment shown in FIGS. 1*a* and 1*b* comprises a floating support 1 of the boat type bearing a power group 2, composed, for example, of a heat engine that drives a hydraulic generator. It also bears a tank 3 sealed on its vertical walls and on the base, but open on the top, which contains the recovered pollutant 9, floating on the water. Lastly, this floating support also bears a fluid lifting device 4 of the paddle belt type, with flexible paddles, adapted for use as an emptying system, and that has an opening 5 on the lower portion positioned at the vicinity of the water plane 6, and a spout 7 on the upper portion that emerges on the top of the tank 3. A tight well 8 crosses the shell in the vicinity of the lift, and contains a float 10 acting on a device 11 of the hydraulic distributor type, for example, that controls the movement of the hydraulic motor of a pump 12, placed in the base of the tank 3. This pump is equipped with a flexible back-flow pipe 13 whose evacuation end can be directed toward any point outside of the shell and, in particular, on the zone of the water table positioned immediately up-stream of the opening 5. The lift with flexible paddles is equipped at the front of the opening 5 with an assembly of two journalled arms 14, preferably floating, positioned flush with the water table in the shape of a "V". This lift is furthermore journalled with respect to the floating support by means of an axis 15 about which a hydraulic jack 16 allows it to move in rotation and to take diverse positions. This hydraulic is equipped with a device making it possible, once it has been arranged in a given position, to give it, if necessary, a degree of liberty that enables its upper end, therefore the entire elevator,to oscillate freely about this position. This can be obtained in a known manner by releasing one of the end axes of the jack which can then slide in an oval shaped space, or yet by using a hydraulic distributor capable of putting the two compartments of the jack, positioned on each side of its piston, in free communication.

The elevator 4 of the paddle belt type with flexible paddles is shown in FIGS. 2*a* and 2*b*. Its upper portion of known type, with its spout 7 and its driving motor 32 is mentioned here as a reminder.

Its lower portion or opening comprises an assembly comprised of two vertical sides 17 and a horizontal base 18, that bears on the up-stream side, i.e., on the left in the drawing, a movable and deformable partition 19 obtained here in the shape of a journalled bellows with sealed hinges, made of a flexible plastic material, for example. This partition is connected to a floating body, or float 20, of a substantially cylindrical or parallelepipidal shape with horizontal generators, that can be displaced vertically between the two sides 17 jointly with the deformation of the bellows 19.

The upper portion of the float is maintained in the vicinity of the water plane, as will be explained herein after, and plays, as a result, the role of a weir. This weir according to the invention can be a member other than the floater it-self provided that it be rigidly connected thereto in all its vertical displacements. The combination of these two members in one represented here, is only a simplification of the embodiment, and one can speak in this case, of a "floating-weir."

At their ends, the weir-floater 20 and the partition 19 are adjusted to an easy fit within the sides 17 that are of a flat shape, in such a manner as to achieve a quasi-seal and at least an extremely low possibility of fluid leaks between the weir-floater assembly and the sides. These sides 17, the base 18, and the bellows partition 19 demarcate a compartment 22. Two floats 23 resting on the table, outside the apparatus and free to displace vertically while being guided between two slides 24 are positioned at the exterior of the sides 17 and placed in a substantially symmetrical manner with respect to the median longitudinal plane of the elevator. These floats 23, whose total volume is clearly greater than that of the float 20, are connected to the float 20 by two bars 25, each equipped with a transverse axis that straddles the sides 17 at the top and are guided by the slides 24. The connection between the float 20 and the floats 23 by the bars 25 is achieved in such a way and with such a play that the float 20 has the possibility of vertically oscillating on a low amplitude, independent of the movements of the floats 23, while being subjected to the movements of these floats beyond this low amplitude, as will be explained further on.

In a known manner, the elevator 4 of the paddle belt type, uses a rotating flexible belt 26 that displaces in the direction of arrow 27. In its ascending portion, therefore lower portion, this belt 26 is adjusted on its lateral sides to an easy fit between two sides 29 that extends the sides 17 over the entire length of the elevator up to the spout 7. The assembly formed by the base 21 and the sides 29 connected in a sealed manner constitutes a tunnel or chute that has in the interior a section in the shape of "U" with sharp angles, that is constant on the length of the elevator. The lower portion of this chute is curved up to its sealed connection with the base 18. The space between the sides 29 can be different from that which exists between the sides 17.

The assembly of the opening comprising the compartment 22 with its different members as well as the lower portion of the chute 21, 29 is preferably achieved in such a way as to be detachable all in one block with, for example, a separation line or break 50 with edges adjusted in a sealed manner, the mounting of this opening being achieved at the level of this break, for example by rapid fasteners of the "knuckle joint" type 51.

The belt 26 is stretched between two cylindrical rotating drums, a lower drum 30 and an upper drum 31, one of which, the upper for example, bears a driving motor 32, that is, for example, hydraulic. This belt 26, in its ascending portion, i.e., its lower side, is guided by a support on the inner surface on a slide 35. It bears, in addition, a series of rectangular paddles or blades 33 of a flexible material, affixed on the external surface of the belt 26, in a sealed manner, via rigid corners 34 held by screws, for example, and adjusted on their end ridges to an easy fit with respect to the sides 17 and 29 that are in a same plane.

These paddles 33 are notable in that they create, with the plane of the belt, an angle on the order of 90°, and that they are of a length slightly larger than the distance between the slide 35 and the base of the chute 21, 29, which causes them to curve slightly when entering this chute and to reassume their flat shape upon passage from the spout 7.

Furthermore, the dimensions of the compartment 22 are such that between the float 20 and the passage of the exterior edges of the paddles 33, a space is reserved so that the paddles can not touch, nor even brush against the weir-float 20.

The functioning is the following: the fluids present in the compartment 22 are confined between each of the paddles that pass there through and the walls 17 and 18 of the compartment 22 first, then the walls of the chute 21, 29, and are transported toward the spout 7 from which they fall into the tank 3. Note that the counter currents capable of existing under the blades before their edge touch the base 18, do not have any reflux effect on the recovered products, since they only affect the interior of the compartment 22. The soft friction achieved between three of the surfaces of each of the paddles and the rigid walls that guide them, maintains a seal in each of the intervals between the paddles, so that these intervals behave as so many close elevator buckets, comprising a bucket pump, and creating a continuous sampling of fluid in the compartment 22.

One sees that the passage of the paddles in the compartment 22, without touching or brushing against the weir-float, can produce no rupture of the film of pollutant that passes above the weir.

Lastly, the flexible paddles being, at their base, substantially perpendicular to the support cloth 26, they are caused to only curve slightly in the chute 21, 29 on an angle on the order of 45°, only causing a deformation and, therefore, very limited fatigue of the materials that constitutes them.

The sketches in FIGS. 3*a*–3*d* make it possible to understand the functioning of the recoverer according to the invention for its portion located in the vicinity of the opening.

In order to further clarify the hereinafter explanations, these schematic FIGS. 3*a*–3*d* adopt the following simplifications:

- the lower portion of the paddle belt, with its drum and its flexible paddles, is not shown and, in this regard, it can be noted that in what follows, that is relative to the functioning of the portion shown in FIGS. 3, the emptying system only intervenes through its flow rate and can therefore be of any type, other than the paddle belt with flexible paddles;
- for an easier comprehension, the two exterior floats 23 are shown in the said FIGS. 3*a*–3*d*, by a single float arranged in front of float 20, therefore, on the right in the sketches, while, in reality, the floats are on the sides;
- in addition, the compartment 22 is only partially shown and is cut by a vertical dashed line. Lastly, the bar 25 is shown in a plane perpendicular to that which it occupies in practice.

In FIGS. 3*a*–3*d*, the following elements are found described in FIGS. 1*a*, 1*b* and 2*a*, 2*b*: the exterior floatation surface 6, the compartment 22, the weir-float 20, the bellows partition 19, the side 17, the bar 25, the float 23, the vertical guiding slides 24. In addition, the connection between the float 20 and the float 23 is shown therein in more detail although in a schematic manner. This connection comprises an axis 36 affixed on the end of the bar 25 and is free to displace vertically in a slot that is open in a vertical extension 37 of the float 23, between the limits of an upper abutment 38 and lower abutment 39. This maximum vertical displacement is characterized by a course 40. Lastly, on these sketches, a layer of floating pollutant 41 is shown.

Figure 3A:
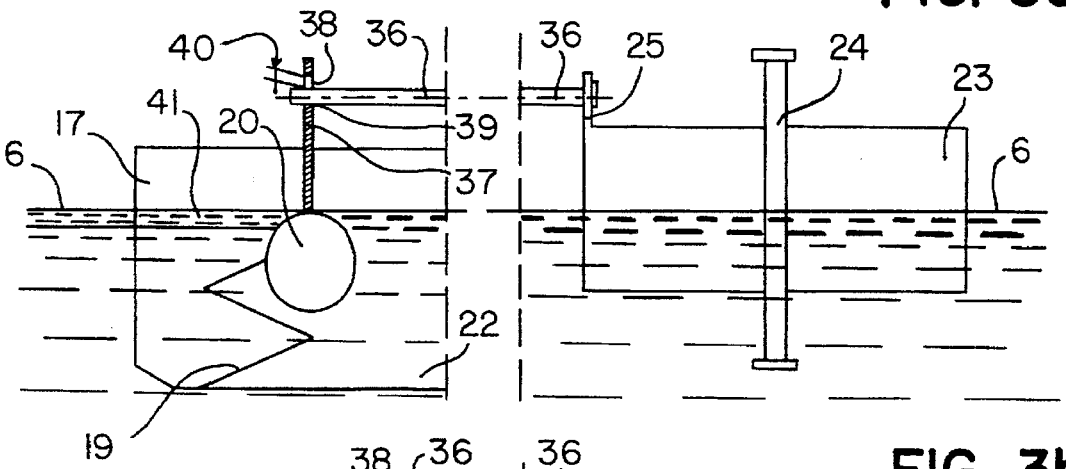
FIGS. 3*a*, 3*b*, 3*c*, 3*d* show, in a schematic manner, this same lower portion in several examples of position of the floating weir.

FIG. 3*a* shows the opening in the normal immersion position on a calm water plane, and before the paddle belt or any other pumping system is put into movement in the compartment 22. This compartment 22 is normally filled to the maximum, i.e., to the exterior level of the water plane, by the play of slight leaks that are inevitable at the ends of float 20 and bellows 19.

Under these conditions, the upper level of the weir-float 20 is such that the floating pollutant can not pass above. The construction adjustment of the relative position of the floats 20 and 23 is achieved in a manner such that, under these conditions, the axis 36 brushes against the lower abutment 39.

Figure 3B:
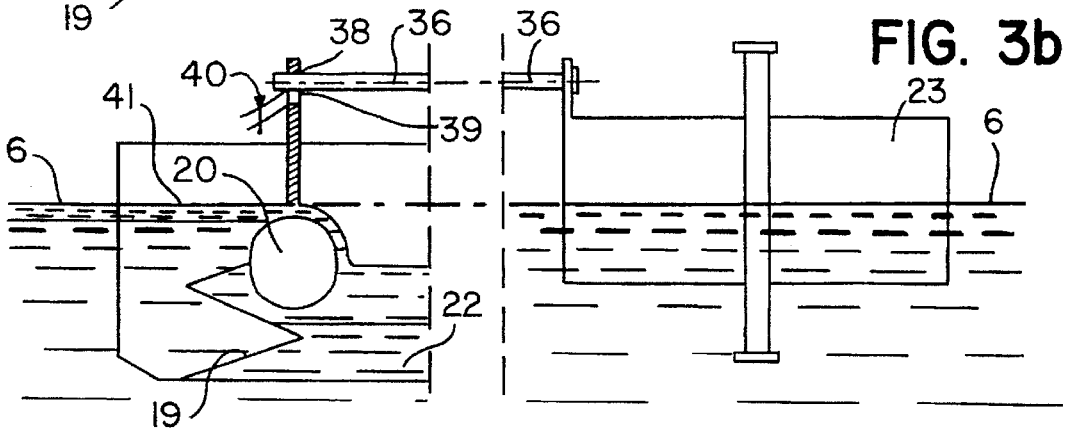

From this position, the functioning is the following. As soon as one pumps in the compartment 22, the level of liquid that it contains drops, driving the float 20 to descend which slightly deforms the bellows 19, and, at its upper portion, frees a space by which the layer of floating pollutant 41 flows toward the compartment 22 as it appears in FIG. 3*b* representative of what takes place at the beginning of this phase, i.e., a small quantity of water still remains in the base of the compartment 22. The level drop in the compartment 22, and therefore of the thickness of the layer 41 being able to pass above the weir 20, are all the more substantial as than the pumping speed is, it-self, important. One can therefore, by simple action of this pumping regime, adapt the level of the weir to the thickness of the layer of pollutant encountered, to recover the maximum amount thereof without allowing excessive amounts of water to enter. This is the known functioning of all the known recovers of the type having a downstream floatation weir. The maximum course 40 is relatively small, on the order of 2–4 centimeters, for example, which corresponds to a maximum thickness of usual layers of floating pollutants such as hydrocarbons.

The invention is notable on this point in that this vertical displacement of the weir-float 20 is free in the limits of this play 40 between the abutments 38 and 39 but is otherwise connected to the movements of the floats 23, therefore being subjected to a double subjection.

If the float 20 is pulled to descend beyond the position of FIG. 3*b* that corresponds to the contact of axis 36 with the top abutment 39 as a result of a possible additional level drop in the compartment 22, the float 20 will not be able to do it, for it is retained by the buoyancy of the float 23 on the exterior water plane. This buoyancy, in light of the dimensions of the float 23 that are clearly more substantial, is such that the loss of buoyancy of the float 20 does not affect the level of the float 23, except for a negligible supplementary sinking.

Figure 3C:
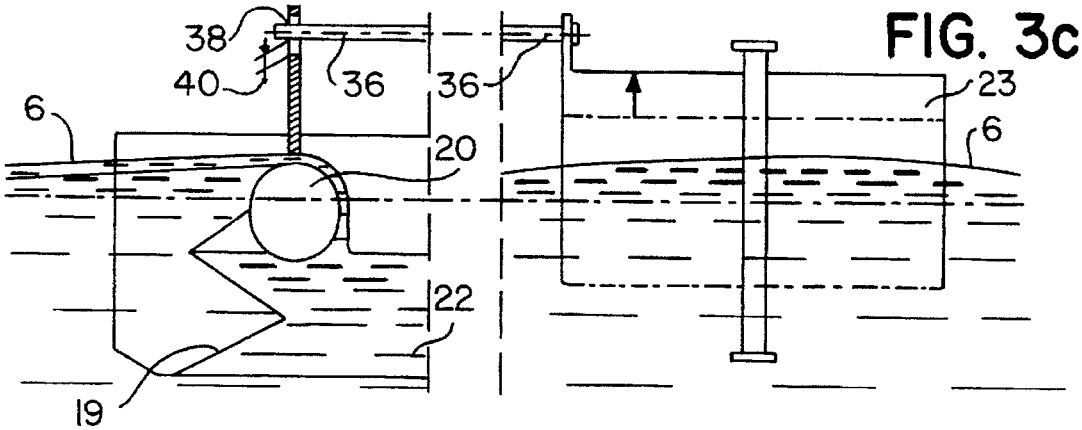

If, from the configuration of FIG. 3*b*, the level 6 is raised, for example by the passage of a wave toward the top of the water plane, such as a swell, lap or relative oscillation of the floating support, the float 23 will follow this level and raise, by upward support of axis 36 on the top abutment 38, the extension 37 and, therefore, the weir-float 20, which instantly takes the position shown in FIG. 3*c*. Under these conditions, the passage of the wave provokes no increase in the height of the possible passage above the weir 20. There is therefore no overflowing from the exterior toward the compartment 22, which would have occurred if it had been necessary to wait for the ascent of the weir-float 20 under the filling effect of the compartment 22, the time necessary for this filling allows for a substantial entry of useless water. The assembly is then found in the configuration of FIG. 3*c*. One can get an idea of the avoided overflowing, if one knows that the amplitude of such a wave, in a relative value, therefore with respect to the floating support, is commonly on the order of about 10 centimeters, even more, therefore without a common measure with the normal height of passage above the weir, which goes from a few millimeters to a maximum of 3 to 4 centimeters. The bellows 19 is, by construction, capable of a deformation compatible with the amplitude of these waves.

If in place of starting, as one did, from the configuration of FIG. 3*b*, one started from an intermediary position, between that of FIG. 3*b* and that of FIG. 3*a*, the functioning would have been identical after considering the taking of the play existing between axis 36 and the top abutment 38. This taking of the play corresponds to a slight increase in the passage height which is, in any case, without a common measure with the avoided overflowing.

Figure 3D:
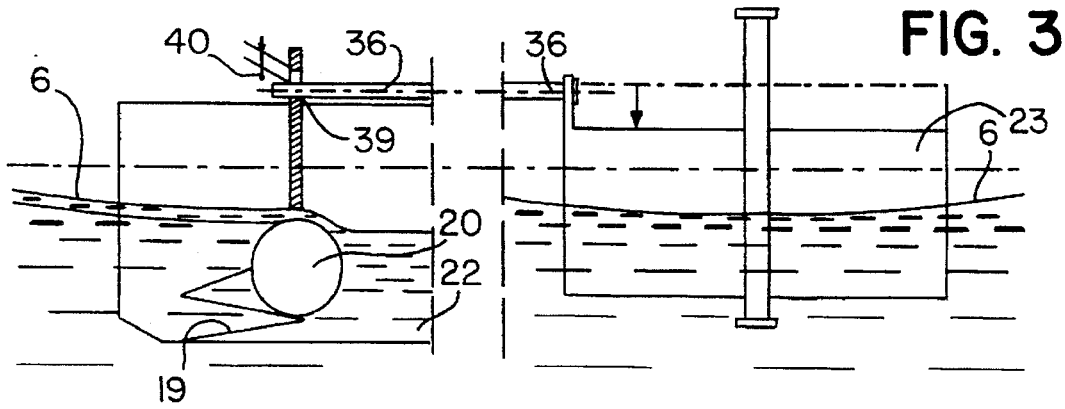

In the inverse case where, from the configuration of FIG. 3*b* for example, the level 6 is dropped by the passage of a recessed wave in the water plane, as in FIG. 3*d*, the float 23 descends, freely at first until taking of the play equal to the course 40 is achieved, then drives in its descent the weir-float 20 that sinks further in the compartment 22, its low buoyancy not being capable of opposing the descending force of the float 23, transmitted by support of the axis 36 on the bottom abutment 39. The upper level of the weir-float 20 is therefore forced to follow the downward movement of the float 23, i.e., that of the water plane 6. One thus avoids the rupture of the passage above the weir that would have taken place if the weir-float had only been connected to the level of fluid in the compartment 22. Indeed, in this case, it would have been necessary to wait for this level drop following a pumping flow on one hand, and the absence of fluid arriving above the weir on the other hand, so that the weir-float lowers. This lowering would therefore have taken place at an inopportune moment with respect to the passage of the recessed wave.

As such a wave is generally followed by a upward wave, one would have stressed again the overflowing indicated above.

Starting at an intermediary configuration between that of FIG. 3*b* and that of FIG. 3*a*, the functioning would be identical after compensation of the play existing at the beginning between axis 36 and the bottom abutment 39, the play then being less than the course 40.

The invention is therefore notable for maintaining substantially constant the height of the passage of fluid above the weir and of causing the weir to adapt itself automatically to the variations of the pumping flow, by variation of the speed of the paddle belt for example, this constancy and this adaptation not being affected by the relative vertical movement of the plane of water with respect to this paddle belt. This arrangement applies furthermore to all pumping systems other than a paddle belt, and in a general manner, to all emptying systems.

Figure 4:
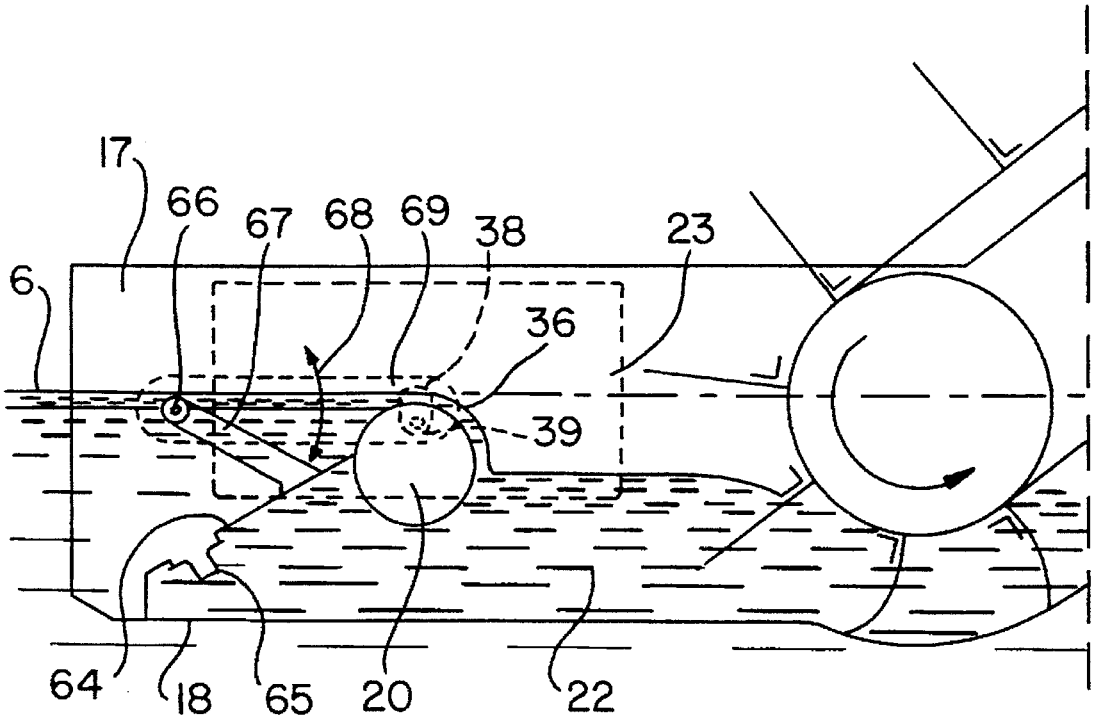
FIG. 4 shows another embodiment of the floating weir with double floatability.

FIG. 4 is a longitudinal cross section of the opening of the paddle belt in an embodiment of the double subjection weir-float, where the movements in vertical translation of this weir-float 20, such as represented in FIG. 3, are replaced by rotational movements, equally substantially vertical.

In this case, the role of the deformable wall of the bellows 19 is played by a flap 64 adjusted at its ends to easy fit inside the sides 17, connected to the base 18 via a sealed flexible blade 65, and that can displace rotationally about an axes 66 to which it is connected by two arms 67. The flap 64 is affixed on the entire length and in a sealed manner to the weir-float 20 of which the displacements therefore follow the same rotation symbolized by the arrow 68.

It is to be noted that, since the axis in rotation 66 is found in the vicinity of the horizontal of the top of the weir-float 20 in mean position, the top of the weir float displaces substantially vertically.

The connection between the weir-float 20 and the floats 23 is here ensured by virtue of the axis 66 that crosses the side 17 and on which, on the one hand, the arm 67 is nested on the inside and, on the other hand, an arm 69 is nested on the outside, in such a manner that the rotation one of these two arms necessarily tends to cause the rotation of the other. The arm 69 comprises a slot at its end in which an axis 36 affixed to float 23 can displace between two abutments, the one top 38, the other bottom 39.

It is understood that the functioning is identical to that which has been previously described, the vertical movements of the floats 23 reacting in the same manner at the level of the float 20, and the latter having the same freedom of vertical oscillations of small amplitude.

Figure 5:
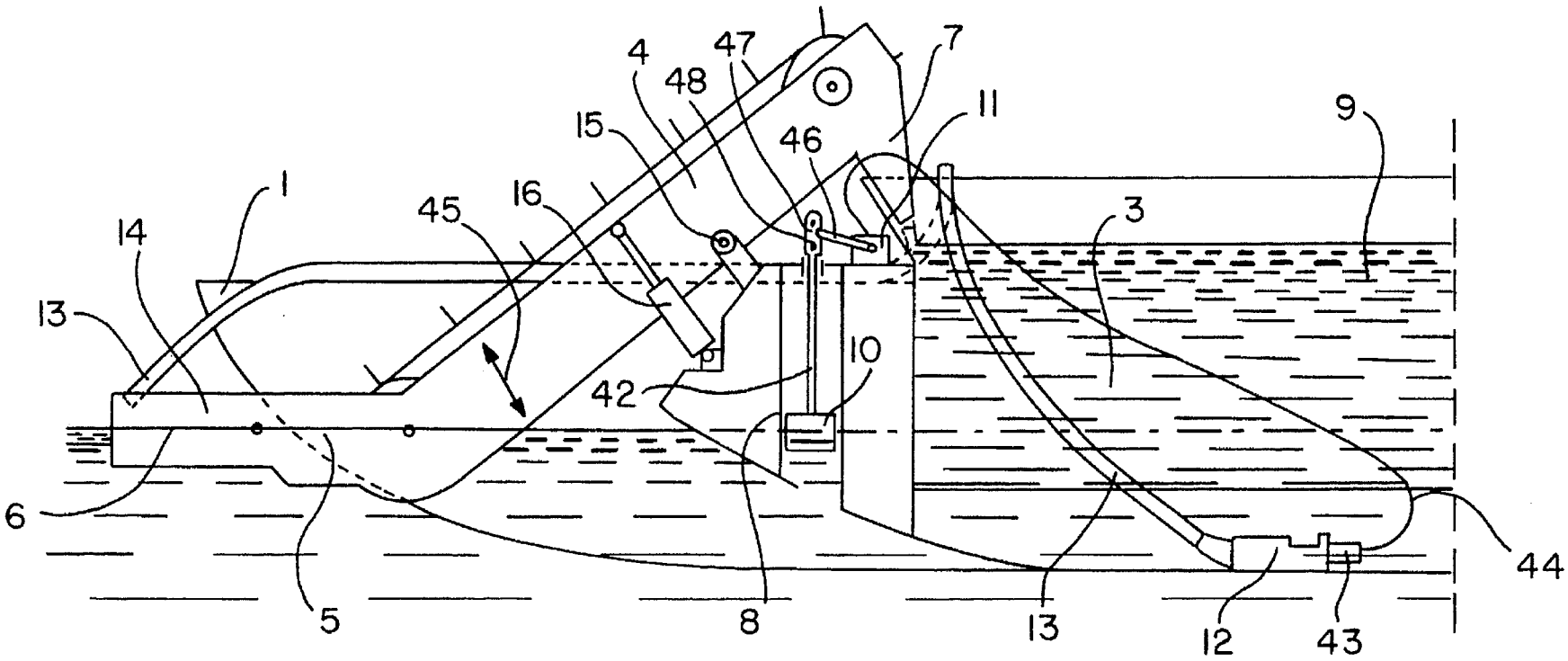
FIG. 5 is a cross-section of the shell of the floating support in the zone of the draft subjugation device.

FIG. 5 is a cross section a front portion of the floating support 1, enlarged with respect to the representation in FIG. 1*a*, such that the details thereof become apparent. The elevator 4, of the paddle belt is found therein and is shown here by a simple silhouette as a reminder, with its spout 7, the pollutant storage tank 3, the sealed wells 8 in communication with the surrounding water through its lower opening, the float 10, the hydraulic distributor 11, the pump 12, the flexible backflow tubing 13, the floating journalled arms 14, the rotation axis 15 and the hydraulic jack 16.

The invention is notable on this point in that the hydraulic distributor 11 is connected, for example, by a rigid shaft 42 to the movements of the float 10, in such a manner that the ascent of this float controls the hydraulic feed of the motor 43 of the pump 12 by the flexible tubing 44 and puts in operation this pump, and reciprocally, the descent of the float 10 controls the stopping thereof.

To function, the tank 3 having an ability of decantation, it is necessary to fill it with water from the beginning of the recovery operation. This operation can be easily carried out by using pump 12 for example.

It must be noted that the pump is normal equipment complementary to the principal equipment, as a means for emptying and transferring the contents of the tank 3. This pump comprises flexible tubing and can therefore be displaced. In particular, it is easy to immerse it manually or by means of a derrick in the water surrounding the floating support while the free end of its flexible backflow tubing 13 is therefore positioned above the tank 3. One activates the pump 12 by manually lifting the control lever 46 of the hydraulic distributor 11. One thus proceeds with filling the tank 3 with water and only stops at a level higher than that which will be conserved during the operation. The filling provokes sinking of the floating support, i.e., an increase in its draft. One then places the pump 12 on the base of the tank and the free end of its flexible tubing 13 toward the exterior, in the positions shown on FIG. 5, then one stops acting manually on the lever 46 that is then connected to the position of the float 10 via the shaft 42. This float is therefore sufficiently immersed to push the shaft 42 and therefore the lever 46 upwards, which keeps the pump 12 running until the water of the tank is sufficiently removed, and therefore the draft diminished, so that the float 10 is no longer pushed upwards, and therefore no longer activates the distributor 11.

At this moment, it is sufficient to act on the control of the hydraulic jack 16 to cause the elevator 4 to rotate about the axis 15 following one of the arrows 45 and brings the level of the opening 5 to a position chosen with respect to the exterior level of the water plane, for example the position of FIG. 3*a*. One then starts the paddle belt that, due to the functioning of the weir previously described, sends some pollutant accompanied by a small quantity of water to the tank 3. The pollutant 9 remains in the upper portion while the water decants downwards, but the increase in total weight of the contents of the tank 3 provokes a slight sinking of the floating support and, at the same time, of the float 10 that immediately acts, as previously, to start the pump which therefore evacuates the water until the return of the preceding draft. The same functioning takes place automatically each time the load of the tank, or any load variation of any type tends to increase the sinking of the floating support 1, and therefore of the opening 5. In particular, during the entire loading of the tank resulting from the recovery operations, this sinking is automatically maintained constant, and it therefore positions of the opening 5 at the same level with respect to the mean level of the water plane. When the pollutant 9 fills the tank 3 up to the base, this pollutant can pass in the pump. It then appears at the end of the tubing 13, thereby giving the signal for stopping the recovery operation. By means of a relative adjustment of the position of the shaft 42 and of the end of the lever 46, with the help of a removable axis 47 and a series of holes 48 at the end of the shaft 42, for example, one can choose stabilized drafts, that correspond to different choices of tank loads. The level of the opening 5 is adapted each time by means of the jack 16.

This characteristic of the invention therefore has the effect of maintaining the entry weir of the recoverer at a constant and chosen mean immersion regardless of the load variations of the floating support, independently of the origin of these load variations.

That which precedes involves equipment and controls of the hydraulic type, that corresponds to the chosen example in FIG. 1, a power group 2 comprising a heat engine and a hydraulic generator which can drive a propulsion helix motor shown as 49 in FIG. 1. It is evident that without leaving the scope of the invention the means for energy transmission, both for these functions as for those cited further on, can be different, for example, compressed air or electricity. In this case, the motors of the elevator, of the pump and of the helix, are of the same nature, i.e., respectively pneumatic or electric. The hydraulic distributor 11 then becomes, according to the case, either a pneumatic distributer, or an electric contactor. In the latter case, the float 10 can be unnecessary and can be replaced by a relay contactor of known type functioning upon contact with the water by passage of current in such water and interruption as soon as the relative level drops. Similarly, the free end of the flexible tubing 13 is positioned upstream from opening 5 in FIG. 1 and in FIG. 5. This position is not absolutely necessary and simply corresponds to the possibility of guarding against an inadvertent spilling out of pollutant (at the end of the filling of the tank 3 when the pollutant reaches the base) toward a zone of the water plane where its presence is not desirable.

Figure 6A:
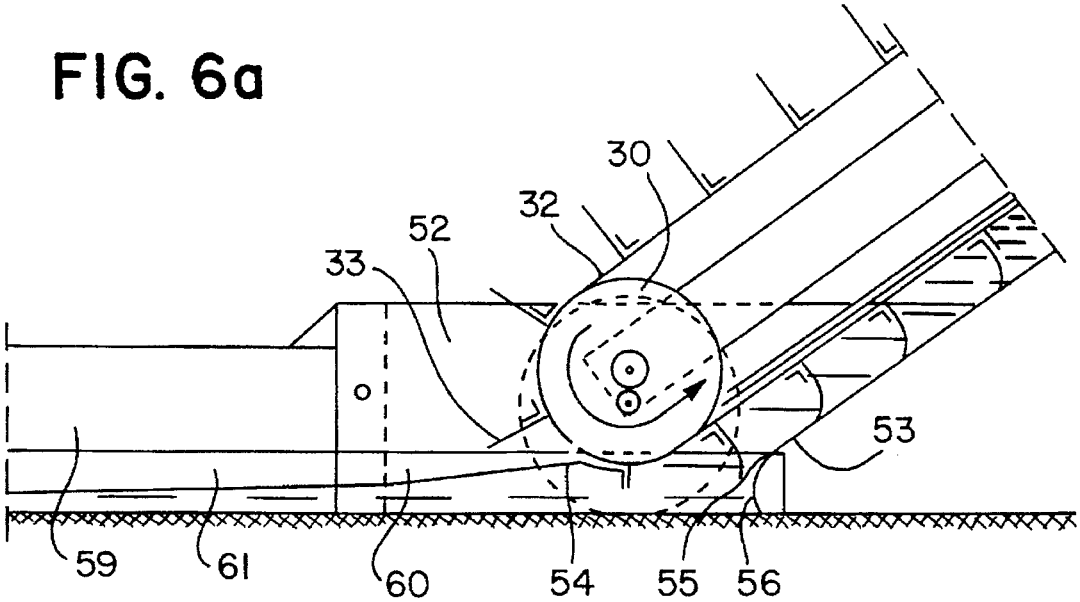
FIG. 6*a* shows, in vertical cross-section , and FIG. 6*b* in perspective, the opening in the "land" configuration.
Figure 6B:
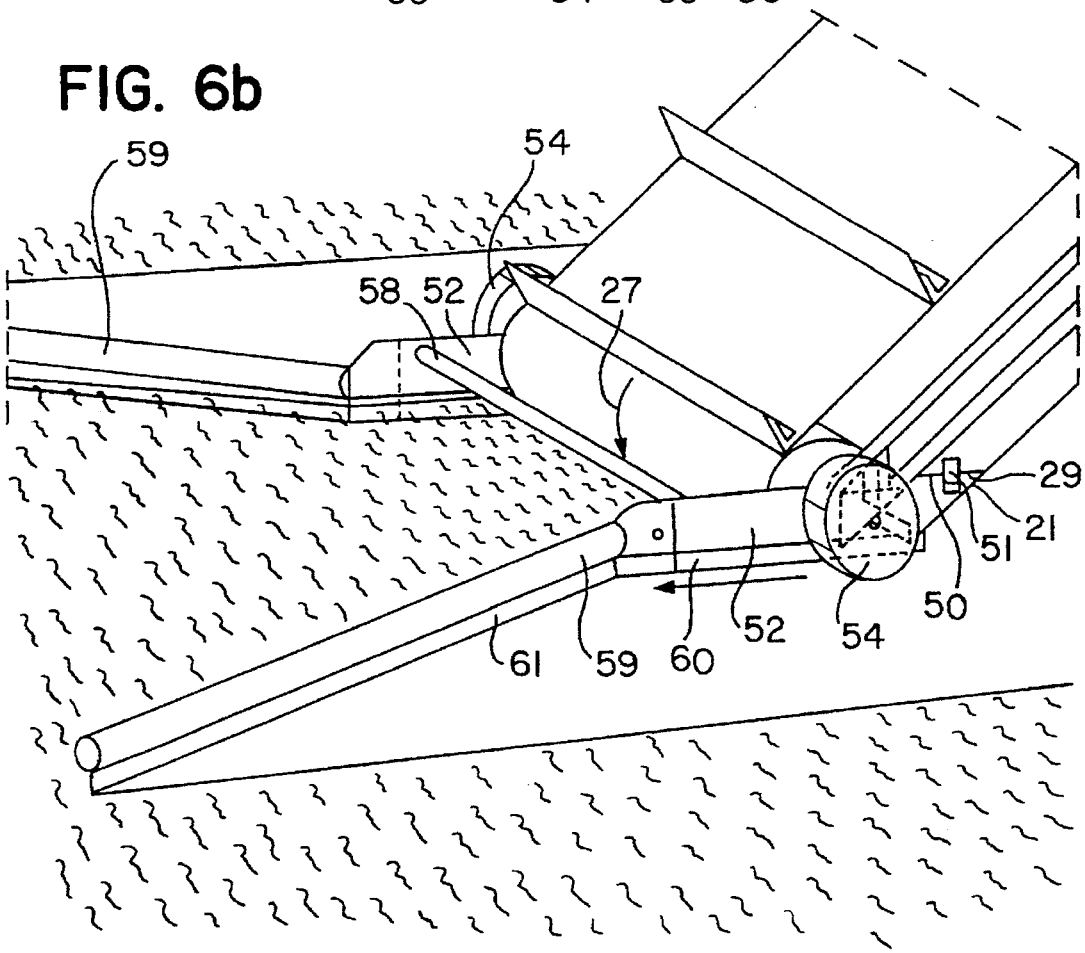

FIGS. 6 show in longitudinal cross-section (FIG. 6*a*) and in perspective view (FIG. 6*b*), the opening of the paddle belt adapted to the recovery of the pollutants that are beached, in the process of being driven aground on the beaches, or simply liquid or semi-liquid pollutants scattered on the ground, on a road, for example. This figure shows a different embodiment of the bottom portion of the paddle belt that is identical to the preceding. One can obtain separate special equipment but it can be preferable that this bottom portion be an interchangeable accessory to be mounted on the same basic equipment. One can therefore detach, as previously described, the assembly or opening comprising the compartment 22 with its different elements and the bottom portion of the chute 21, 29 and replace it with the interchangeable opening of FIG. 6. This opening also adjusted in a sealed manner to the chute 21, 29 at the level of the cutoff 50 and fixed to such chute by means of quick fasteners 51, comprises two sides 52, a base 53, and two wheels 54. The sides 52 are terminated at their bottom portion by blades 60 constituted by a sheet of flexible material, that extend up to the rear of the entry edge 55 of the base 53. Along this edge is tangentially affixed a flexible transverse blade 56 whose length is equal to the width of the base 53. Furthermore, the support point of these wheels on the ground is preferably near the vertical of the rotational axis of the drum 30, the diameter of these wheels being such that the paddles 33 that touch the ground in the vicinity of this support point naturally assume a curve similar to that which they have in the chute 21, 29.

A transverse bar 58, for example, makes it possible to provide this interchangeable opening with a sufficient rigidity. In addition, the sides 52 can be extended frontwardly, i.e., toward the left of FIG. 6, by two symmetrical "V"-shaped arms 59, detachable or not,equipped at their base with flexible paddles 61 similar to the paddles 60.

The invention is notable on this point by the fact that the recovery elevator for the water is capable of easily receiving an opening open at the lower portion and comprising scraping elements with flexible paddles.

The functioning when the elevator is used on the ground is the following. After the interchangeable opening of FIG. 6 is positioned, the elevator of the paddle belt is brought by control of the hydraulic jack 16, to a position such as its wheels 54 are slightly above the ground. At this moment, the elevator is freed from its connection to the jack 16 as has previously been described, and therefore comes to rest on the ground via said wheels 54. The drum 30, and therefore the belt 32 being put into movement in the direction of the arrow 27, the paddles 33 bend and "scrape" the ground. By causing the assembly of the elevator to advance toward the left of FIG. 6, by a rolling support for example, the assembly encounters the pollutants that are "swallowed" and pushed by the paddles 33 toward the base 53 and the chute 21, 29 along which they climb up to the spout 7. The flexible blades 56 prevent these products from escaping by the rear and the go from escaping by the sides. These products, often viscous hydrocarbons, are therefore scraped on the ground and recovered in a continuous manner. The freedom of vertical oscillation of the support of the elevator on the wheels in the vicinity of the scraping zone causes the paddles 33 to follow exactly the possible unevenness of the ground, for example of wet sand at low tide. The complementary use of the arms such as 59 with their flexible blades 61 enables a greater width of ground to be swept, the advance movement of the assembly funnels and concentrates the pollutants towards the space situated between the two sides 52.

One sees that such an arrangement permits, by simply changing a removable opening and by furthermore using the same apparatus as for floating pollutants, to recover pollutants that are beached, or that are in the process of being driven aground on beaches, or yet products that are spilled on the ground on substantially flat surfaces.

FIG. 7*a* shows in longitudinal cross-section and FIG. 7*b* in top view, a floating support 1 of the type of that in FIG. 1, with its different components, and in particular the elevator 4, of the paddle belt, that is capable of amphibious recovering either the opening is for floating recovery, or the opening is for ground scraping, such as have been previously described. In addition, this floating support 1 was made capable to be displaced on the ground. To this end, it is equipped with two wheel trains, one 62 at the rear, the other 63 at the front. In the example of FIG. 7, the front wheel train is limited to a single and directional wheel. In the case of a support equipped with a hydraulic power group, the wheels can be, for example, equipped with individual hydraulic motors 70 and 71. The guiding operation of the front train can also be, in this case, ensured by a hydraulic jack 72. The wheels, due to hydraulic jacks 73 can 74, and be retracted into the shell to improve hydrodynamics when it floats. These same jacks 72 and 73 enable the wheel trains to come out so as to displace on the ground.

The invention is notable on this point by the embodiment of the recovery means previously described, from a single amphibious support capable of moving on the water and on the ground.

With the equipment according to the invention, to pass from recovery on the water to recovery on the beach, it suffices to make the floating support displace on its wheels. One then continues the recovery work of the pollutants in the zone where the shallow depth does not permit it to float. The opening of the weir-float can be used as long as this depth is still sufficient to allow the floating of the floats 23. Next, in the zone where the waves or the tide have placed pollutants on the sand, a simple change of the opening allows the cleaning and recovery work to continue normally and without interruption. It suffices to put the elevator of the paddle belt in the lower position by the hydraulic jack 16. In this latter configuration, the equipment can also recover liquid or viscous products spilled on relatively flat ground, as on a road, for example.

What is claimed:

1. An apparatus for recovering floating matter comprising:

a recovery compartment for receiving matter to be recovered;

a weir comprising at least one float, the weir capable of being at least partially immersed in the recovery compartment;

an emptying system for the recovery compartment; and at least one exterior float connected to the weir such that the at least one exterior float may be borne by an exterior water plane exterior to the recovery compartment such that the weir is sensitive both to level variations in the recovery compartment and to relative movements of the exterior water plane.

2. The apparatus of claim 1, wherein the connection between the weir and the at least one exterior float allows relative movement between the weir and the at least one exterior float.

3. The apparatus of claim 1, wherein the recovery compartment is demarcated by a base, lateral sides and the weir, and wherein the weir has a shape of a transverse float and further wherein the base and weir are connected by a deformable partition.

4. The apparatus of claim 3, wherein the emptying system comprises an inclined continuous flexible belt, mounted endless between two drums, a motor in at least one of the two drums, the flexible belt bearing a plurality of flexible transverse paddles that displace in a tunnel formed of two flat vertical sides and an inclined base, the inclined base having a bottom portion connected to the lateral sides and the base of the recovery compartment, and wherein the weir and the paddles are spaced such that the paddles cannot touch the weir.

5. The apparatus of claim 4, wherein the paddles displace in an adjusted manner.

6. The apparatus of claim 4, wherein, when the paddles are at rest, the paddles and a plane of the belt form an angle that is close to 90 degrees.

7. The apparatus of claim 4, wherein the paddles are scraping paddles.

8. The apparatus of claim 1, further comprising a floating support comprising a storage tank and a device to automatically maintain a draft of the floating support substantially constant, wherein the device comprises a mechanism sensitive to the exterior water plane, mounted to act on a control device of a pump capable of evacuating contents of the storage tank to an exterior in quantities that are necessary to maintain a relatively constant position of the exterior water plane with respect to the floating support.

9. The apparatus of claim 8, wherein the mechanism sensitive to the exterior water plane comprises at least one float capable of floating on the exterior water plane.

10. An apparatus for recovering both floating matter and matter on ground comprising:

a recovery compartment for receiving recovered matter;

a weir comprising at least one float, the weir capable of being at least partially immersed in the recovery compartment;

an emptying system for the recovery compartment comprising an inclined continuous flexible belt, mounted endless between two drums, a motor in at least one of the two drums, the flexible belt bearing a plurality of flexible transverse paddles that displace in a tunnel formed of two flat vertical sides and an inclined base, the inclined base having a bottom portion connected to the lateral sides and the base of the recovery compartment, and wherein the weir and the paddles are spaced such that the paddles cannot touch the weir; and at least one exterior float connected to the weir such that the at least one exterior float may be borne by an exterior water plane exterior to the recovery compartment such that the weir is sensitive both to level variations in the recovery compartment and to relative movements of the exterior water plane;

a ground system that is equipped with wheels allowing movement on the ground and that is open at a lower portion to allow the flexible paddles to extend such that the paddles in cooperation with scraping paddles may recover materials spilled or beached on the ground; and wherein a lower portion of the apparatus, including the recovery compartment, the weir and the at least one exterior float, is detachable from the emptying system along a line of separation and replaceable by the ground system.

11. The apparatus of claim 10, wherein the paddles are blades.

12. The apparatus of claim 10, wherein the connection between the weir and the at least one exterior float allows relative movement between the weir and the at least one exterior float.

13. The apparatus of claim 10, further comprising a floating support comprising a storage tank and a device to automatically maintain a draft of the floating support substantially constant, wherein the device comprises a mechanism sensitive to the exterior water plane, mounted to act on a control device of a pump capable of evacuating contents of the storage tank to an exterior in quantities that are necessary to maintain a relatively constant position of the exterior water plane with respect to the floating support.

14. The apparatus of claim 13, wherein the mechanism sensitive to the exterior water plane comprises at least one float capable of floating on the exterior water plane.

15. An apparatus for recovering both floating matter and matter spilled on ground comprising:

a recovery compartment for receiving recovered matter;

a weir comprising at least one float, the weir capable of being at least partially immersed in the recovery compartment;

an emptying system for the recovery compartment;

at least one exterior float connected to the weir such that the at least one exterior float may be borne by an exterior water plane exterior to the recovery compartment such that the weir is sensitive both to level variations in the recovery compartment and to relative movements of the exterior water plane; and an amphibious support for floating and rolling, and for supporting the recovery compartment, the weir, the emptying system, and the at least one exterior float.

16. The apparatus of claim 15, wherein the connection between the weir and the at least one exterior float allows relative movement between the weir and the at least one exterior float.

17. The apparatus of claim 15, wherein the emptying system comprises an inclined continuous flexible belt, mounted endless between two drums, a motor in at least one of the two drums, the flexible belt bearing a plurality of flexible transverse paddles that displace in a tunnel formed of two flat vertical sides and an inclined base, the inclined base having a bottom portion connected to lateral sides and a base of the recovery compartment, and wherein the weir and the paddles are spaced such that the paddles cannot touch the weir.

18. The apparatus of claim 17, wherein the paddles are scraping paddles.

19. The apparatus of claim 15, further comprising a storage tank and a device to automatically maintain a draft of the amphibious support substantially constant, wherein the device comprises a mechanism sensitive to the exterior water plane, mounted to act on a control device of a pump capable of evacuating contents of the storage tank to an exterior in quantities that are necessary to maintain a relatively constant position of the exterior water plane with respect to the amphibious support.

20. The apparatus of claim 19, wherein the mechanism sensitive to the exterior water plane comprises at least one float capable of floating on the exterior water plane.

* * * * *